US006794614B2

(12) United States Patent
Taniguchi et al.

(10) Patent No.: US 6,794,614 B2
(45) Date of Patent: Sep. 21, 2004

(54) CERAMIC HEATER WITH LEAD WIRE CONNECTION HAVING BRAZING MATERIAL CONTAINING A PREDOMINANT AMOUNT OF COPPER

(75) Inventors: Masato Taniguchi, Aichi (JP); Manabu Okinaka, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 15 days.

(21) Appl. No.: 10/091,445

(22) Filed: Mar. 7, 2002

(65) Prior Publication Data

US 2002/0170903 A1 Nov. 21, 2002

(30) Foreign Application Priority Data

Mar. 8, 2001 (JP) ..... 2001-065798

(51) Int. Cl.[7] ..... H05B 3/00
(52) U.S. Cl. ..... 219/270; 219/541; 219/544
(58) Field of Search ..... 219/270, 544, 219/541; 338/329

(56) References Cited

U.S. PATENT DOCUMENTS 2,629,922 A * 3/1953 Finch ..... 338/274
4,426,033 A * 1/1984 Mizuhara ..... 228/56.3
RE35,521 E * 5/1997 Mizuhara ..... 420/489
6,078,028 A * 6/2000 Cooper et al. ..... 219/541
6,110,605 A * 8/2000 Taniguchi ..... 428/627
6,118,110 A 9/2000 Kobayashi et al.
6,121,590 A 9/2000 Kobayashi et al.
6,268,069 B1 * 7/2001 Ohashi et al. ..... 428/621
6,512,210 B2 * 1/2003 Tanaka et al. ..... 219/541

FOREIGN PATENT DOCUMENTS

JP 60-48421 * 3/1985
JP 60-48422 * 3/1985
JP 4-32615 * 2/1992
JP 7-272832 10/1995
JP 10-284231 * 10/1998
JP 11-16664 * 1/1999

* cited by examiner

*Primary Examiner*—John A. Jeffery
(74) *Attorney, Agent, or Firm*—Sughrue Mion, PLLC

(57) ABSTRACT

A joint structure which does not exhibit impaired joining strength induced by exposure to heat cycles and the occurrence of migration, in a ceramic heater for a glow plug or like device. A heating element 6 is embedded in a silicon nitride ceramic substrate 5. Lead wires 15 are joined to corresponding lead wire connection terminals 11, which are connected to the heating element 6 while electrical continuity is established therebetween, by use of a brazing metal 20 which contains a predominant amount of copper. The brazing metal 20 used for joining assumes the form of a brazing metal layer having a thickness of 30–400 $\mu$m.

15 Claims, 5 Drawing Sheets

CERAMIC HEATER WITH LEAD WIRE CONNECTION HAVING BRAZING MATERIAL CONTAINING A PREDOMINANT AMOUNT OF COPPER

BACKGROUND OF THE INVENTION

1. Field of the Invention

The present invention relates to a ceramic heater, and more particularly to a ceramic heater applied to a glow plug used, for example, to accelerate startup of a diesel engine or applied to, among others, a heater used to ignite a kerosene fan heater.

2. Description of the Related Art

By virtue of its high strength at room temperature as well as at high temperature and small coefficient of thermal expansion, a silicon nitride ceramic heater is widely used in a glow plug or a like device. FIG. 7 shows an example of a silicon nitride ceramic heater 72 for use as a glow plug. The ceramic heater 72 is configured such that a turned (U-shaped) heating element (hereinafter also referred to as a heating element) 76 formed of electrically conductive ceramic is embedded in a ceramic substrate 75 formed of silicon nitride ceramic at a portion biased toward a front end 72*a*. Junction wires 78 and 79, which are formed of a high-melting-point metal, such as tungsten or molybdenum, each have one end connected to a corresponding end portion 76*c* (corresponding leg end portion) of the U-shaped heating element 76. The remaining end portions of the junction wires 78 and 79 are exposed on the side surface of the ceramic heater 72 in the vicinity of a rear end 72*c* of the ceramic heater 72, thereby serving as a pair of lead wire connection terminals (hereinafter also referred to as terminals) 81. A metallization layer (not shown) is formed on the surface of the ceramic substrate 75 in the vicinity of the lead wire connection terminals 81. Lead wires 15 are jointed to the corresponding terminals 81 by use of an Ag-based active brazing metal. This is a general joint structure for the ceramic heater 72.

In order to meet demand for a reduction in size, the ceramic heater 72 itself is shortened, with a resultant reduction in the distance between the front end 72*a* and lead wire joints where the lead wires 15 and the lead wire connection terminals 81 are connected. Thus, for the case where the ceramic heater 72 is installed as a glow plug in a subsidiary chamber of an engine, the temperature of the lead wire joints (hereinafter also referred to as joints) was once 200° C. at the highest, but in recent years the lead wire joints have been exposed to a high temperature of 300° C. or higher.

3. Problems to be Solved by the Invention

However, exposure of the joints to such high temperature has raised the following problem. Namely, a problem arises in a conventional joint structure using an Ag-based brazing metal in that the joint between a lead wire and a lead wire connection terminal suffers separation (unjoining), which is considered to be caused by migration.

One measure for coping with the problem is, for example, to impart a high melting point to an Ag-based brazing metal by employing an Ag rich composition so as to enhance heat resistance of lead wire joints. However, since a glow plug is exposed to severe heat cycles in the course of use, in order to ease generation of thermal stress in ceramic caused by a difference in thermal expansion coefficient between ceramic and an Ag-based brazing metal, such a joint structure is desirably configured such that copper, which is easily deformable, is present in the form of a buffer plate at an intermediate portion of a layer of brazing metal (hereinafter also referred to as a brazing metal layer). The joint structure is not compatible with an Ag-rich composition, for the following reason. An Ag-rich composition induces a eutectic reaction between Ag and copper; thus, a buffering effect cannot be expected. Also, use of a nickel buffer plate is not compatible with Ti contained as an activation metal in a brazing metal and thus is not applicable to the joining work. If Ti is contained in a brazing metal, Ti reacts strongly with Ni to form a layer of an intermetallic compound, thereby impairing joining strength.

Further, a technique has been proposed for preventing migration in joining by use of an Au-based brazing metal, which contains a predominant amount of gold (Au). However, this technique fails to meet the demand for reduction in cost. Further, few combinations of an Au-based brazing metal and an activation metal to be contained therein improve wettability in brazing to ceramic. Therefore, joining by use of an Au-based brazing metal is not practicable.

SUMMARY OF THE INVENTION

The prevent invention has been accomplished in view of the above-described problems, and an object of the invention is to provide a joint structure which does not impair joining strength induced by exposure to heat cycles, does not increase cost, and does not cause migration.

The above-described object has been achieved in a first aspect of the invention by providing a ceramic heater comprising a heating element embedded in an insulating ceramic substrate, and a lead wire joined to a lead wire connection terminal (electrode leading-out portion), which is connected to the heating element while electrical continuity is established therebetween, by means of a brazing metal which contains a predominant amount of copper.

A brazing metal which contains a predominant amount of copper exhibits excellent migration resistance and can retard generation of residual stress stemming from the difference in thermal expansion between electrically conductive ceramic and a lead wire, by virtue of copper's easy deformability, thereby exhibiting only slight impairment in joining strength even upon exposure to heat cycles. Therefore, the ceramic heater of the present invention, in which lead wires are joined to lead wire connection terminals by use of such a brazing metal, can assume a joint structure which is free from the occurrence of migration without an increase in cost. As a result, the ceramic heater can assume a joint structure of high durability, heat resistance, and reliability.

In order to utilize such characteristics of copper, in a second aspect of the invention, preferably, the brazing metal contains copper in an amount of not less than 85% by mass. Also, in a third aspect of the invention, preferably, the brazing metal contains Ti or Si as an activation metal to thereby avoid the necessity of forming a metallization layer. Si effectively enhances wettability in brazing to metal or ceramic. However, a brazing metal which contains a large amount of Si suffers low ductility in the course of production thereof. In view of these phenomena, preferably, Si is contained in an amount of 0.1–5% by mass. Ti effectively enhances wettability in brazing to ceramic and contributes most to enhancement of wettability. However, when the Ti content is excessive, a brazing metal layer formed by joining exhibits increased hardness and thus becomes brittle. In view of these phenomena, in a fourth aspect of the invention, preferably, the Ti or Si content of the brazing metal is 0.1–5% by mass.

A fifth aspect of the invention is directed to the ceramic heater as described in any one of the first through fourth aspects, wherein a pad is formed on the lead wire so as to serve as a joining surface to be joined to the lead wire connection terminal, the lead wire being joined to the lead wire connection terminal via the pad. Joining via such a pad is particularly preferred when a lead wire has a circular cross section, since reliability of joining is enhanced. Notably, the pad may be formed of an Fe—Ni alloy plate, an Fe—Ni—Co alloy plate, an Ni plate, or a like plate and welded to an end portion of a lead wire. Alternatively, an end portion of a lead wire may be rolled into a planate or flat shape.

In a sixth aspect of the invention, the thickness of a layer of the brazing metal is 30–400 $\mu$m. This thickness range of the brazing metal layer is suited for reducing residual stress in ceramic by absorbing the difference in thermal expansion between ceramic and a lead wire as observed after joining, by utilizing the of easy plastic deformability of copper. The lower limit of the thickness range is far thicker than the thickness of a brazing metal layer in joining by use of an Ag-based brazing metal, for the following reason. Since a copper brazing metal exhibits high viscosity even near its melting point, a thin layer of copper brazing metal tends to suffer generation of pores due to insufficient spread of the brazing metal over the interface of joining, potentially resulting in insufficient joining strength. A peripheral portion of the brazing metal layer is particularly prone to this problem. However, employing a large thickness of not less than 30 $\mu$m increases the amount of liquid phase at the time of melting, to thereby avoid the problem.

As discussed above, since copper exhibits easy plastic deformation, copper effectively retards, through deformation thereof, generation of residual stress in ceramic stemming from the difference in thermal expansion between ceramic and a lead wire. However, when the thickness of a brazing metal layer is less than 30 $\mu$m, copper becomes less deformable, and the effect of retarding generation of residual stress cannot be expected. By contrast, since the thermal expansion coefficient of copper is far greater than that of ceramic, preferably, the thickness of a brazing metal layer is not in excess of 400 $\mu$m. When the thickness of a brazing metal layer (a brazing metal layer which contains a predominant amount of copper) exceeds 400 $\mu$m, thermal stress generated in the brazing metal layer becomes too large to yield a buffering effect through deformation of copper. The thus-generated large stress acts on the interface of joining with ceramic, potentially causing unjoining.

More preferably, in a seventh aspect of the invention, the thickness of a layer of the brazing metal is 50–300 $\mu$m. Far more preferably, in an eighth subject of the invention, the thickness of a layer of the brazing metal is 150–250 $\mu$m.

A ninth aspect of the invention is characterized in that an interjacent buffer plate formed of copper is present in a layer of brazing metal to join the lead wire and the lead wire connection terminal, and the thickness of the layer of brazing metal includes that of the buffer plate. In the present invention, when a brazing metal which contains a predominant amount of copper is used with an interjacent buffer plate formed of copper, a brazing metal layer includes the buffer plate.

DESCRIPTION OF REFERENCE NUMERALS

Figure 1:
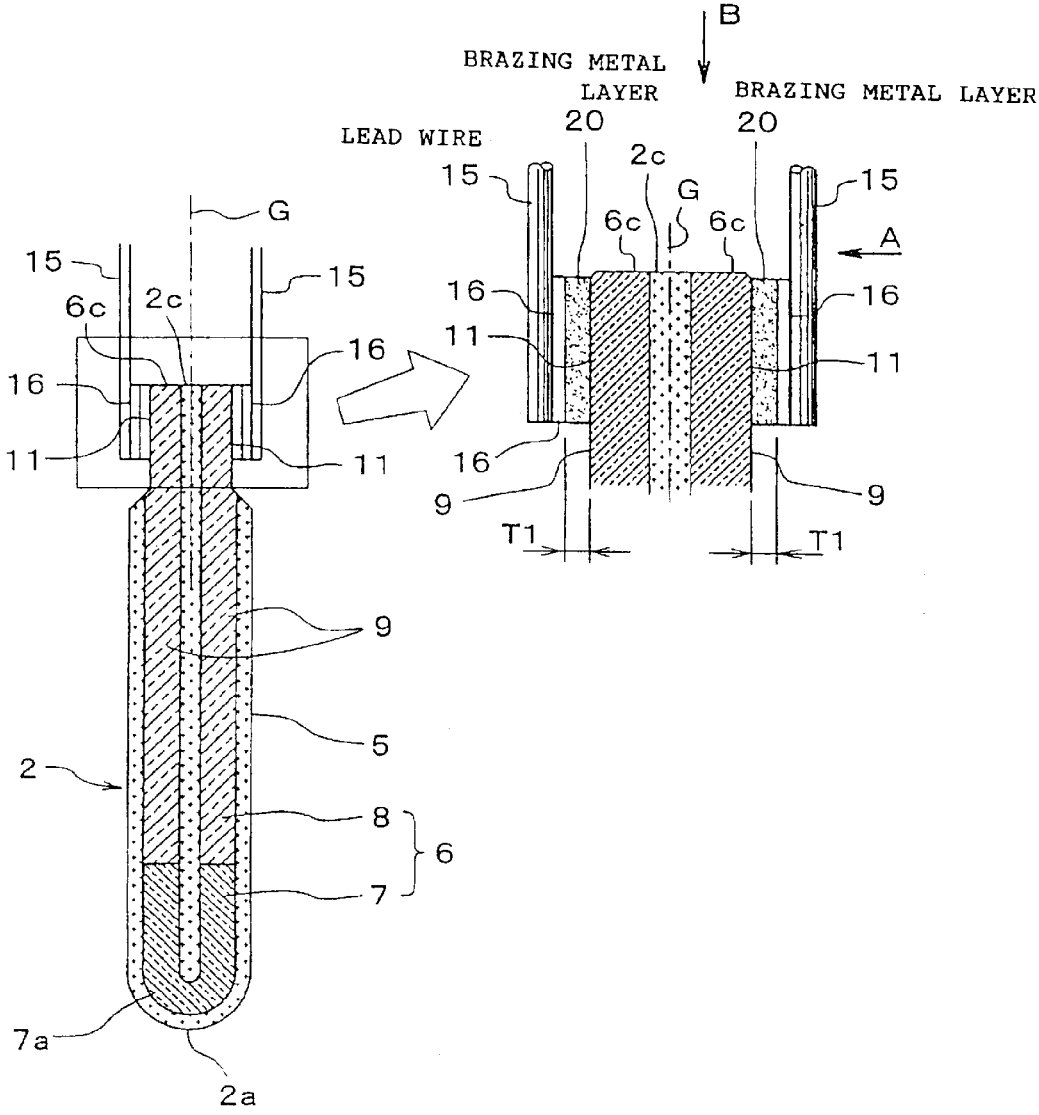
FIG. 1 is a vertical front section of an embodiment of a ceramic heater device (glow plug) according to the present invention and enlarged view of lead wire joints between electrode leading-out terminals and lead wires in the embodiment.

2, 22: ceramic heater
5: silicon nitride ceramic substrate
7, 8: electrically conductive ceramic
6: heating element
15: lead wire
16: pad of lead wire
11: lead wire connection terminal
20: brazing metal (brazing metal layer) for connection with lead wire connection terminal
25: buffer plate formed of copper
G: axis of ceramic heater

DETAILED DESCRIPTION OF THE PREFERRED EMBODIMENTS

Figure 2:
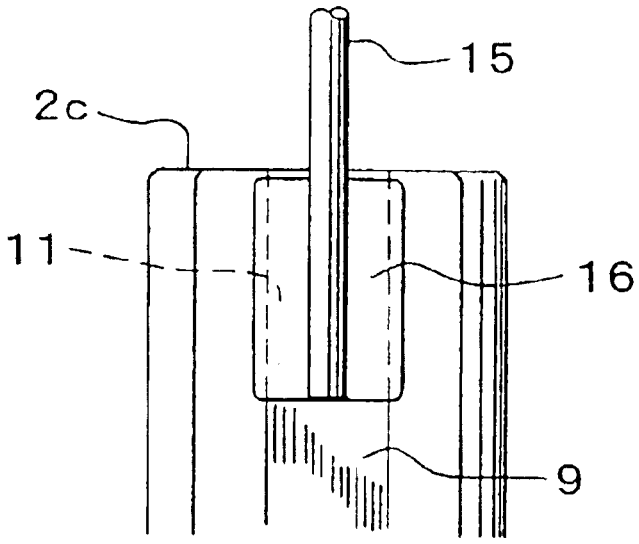
FIG. 2 is a view in the direction of arrow A in the enlarged view of FIG. 1.
Figure 3:
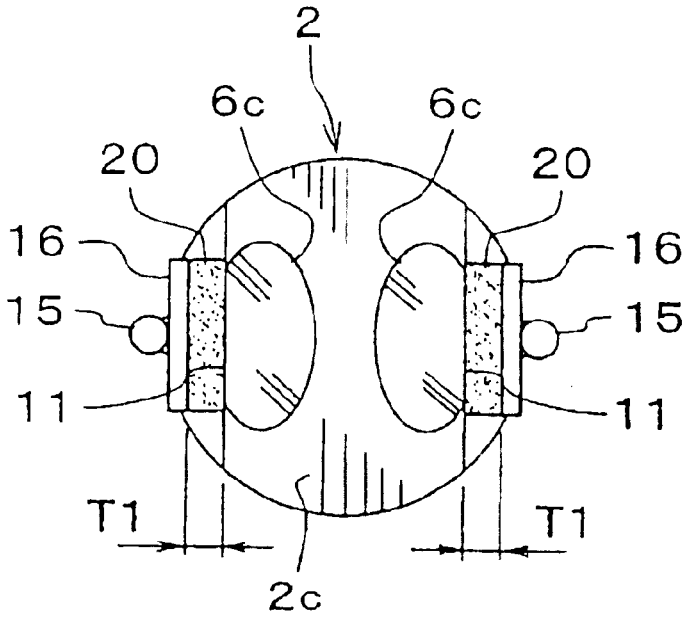
FIG. 3 is a view from the rear end of the ceramic heater (as viewed in the direction of arrow B) in the enlarged view of FIG. 1.

An embodiment of the present invention will be described in detail with reference to FIGS. 1 to 3. However, the present invention should not be construed as being limited thereto. In FIGS. 1 to 3, reference numeral 2 denotes a ceramic heater of the present embodiment, which is configured such that a substantially U-shaped ceramic heating element 6 formed of electrically conductive ceramic is embedded, in a cast-in insert condition, in a silicon nitride ceramic substrate 5 having the form of a round bar having a diameter of 3.5 mm and a length of 25 mm while a turned portion 7*a* in the shape of the letter U is located on the side toward the front end of the ceramic heater 2. The ceramic heating element 6 extends itself between the turned portion 7*a* located in the vicinity of a front end 2*a* of the ceramic heater 2 and a portion located in the vicinity of a rear end 2*c* of the ceramic heater 2. According to the present embodiment, the ceramic heating element 6 has a composite structure such that a ceramic heating element 7, which includes the turned portion 7*a* and has a composition of high resistance, is disposed on the side toward the front end 2*a*, and a ceramic heating element 8, which does not include the turned portion 7*a* and has low resistance, is disposed on the side toward the rear end 2*c*. Such a composite structure is formed by preparing two green ceramic substrate halves capable of accommodating a green ceramic heating element, sandwiching the green ceramic heating element between the green ceramic substrate halves, hot-pressing the assembly into a single unit, and simultaneously firing the unit.

According to the present embodiment, the ceramic substrate 5 and the ceramic heating element 6 are ground in a planar condition such that opposite outward side surfaces of two legs 9 of the ceramic heating element 6 are exposed along a predetermined length from end faces (rear ends) 6*c* in parallel with an axis G of the ceramic heater 2. The thus-ground-and-exposed surfaces of the two legs 9 of the ceramic heating element 6 serve as lead wire connection terminals 11. The length of the lead wire connection terminals 11 along the axis G may be determined in view of the thickness and width of metallic lead wires 15 so as to obtain appropriate strength in relation to joining with the lead wires 15. In the present embodiment, the lead wire connection terminals 11 have a length of 6 mm and a width of 3 mm. Also, in the present embodiment, the two lead wire connection terminals 11 are planar in parallel with each other.

In the ceramic heater 2 of the present embodiment, the exposed surfaces of two legs of the ceramic heating element 6 serve as the lead wire connection terminals 11, and the lead wires 15, which have a diameter of 0.7 mm and a circular cross section and are formed of nickel, are joined to the lead wire connection terminals 11. However, in the present embodiment, pads 16 are welded to the corresponding end portions of the lead wires 15, so that the lead wires 15 are joined to the lead wire connection terminals 11 via the pads 16. The joining work uses a brazing metal (hereinafter also referred to as a copper brazing metal) 20 which contains copper in an amount of 95% and Si and Ti, which serve as activation metals, in an appropriate amount (0.1–5%), and is performed such that the thickness T1 of a brazing metal layer (hereinafter also referred to as a copper brazing metal layer) 20 is about 60 $\mu$m. The pads 16 are substantially rectangular plates, which measure 3 mm×1.5 mm×0.2 mm (thickness) and are formed of an Fe—Ni—Co alloy.

Next an action or effect in relation to a joint structure will be described in which the lead wires 15 are joined to the corresponding lead wire connection terminals 11 of the heating element 6, which partially constitutes the ceramic heater 2 of the present embodiment, using a copper brazing metal. In the present embodiment, the lead wires 15 are joined to the corresponding lead wire connection terminals 11 using the copper brazing metal (a brazing metal which contains a predominant amount of copper) 20, to thereby effectively prevent the occurrence of migration at corresponding joints. Since the brazing metal layer 20 has a large thickness T1 of about 60 $\mu$m, even upon exposure to heat cycles, the brazing metal layer 20 is deformed easily, thereby moderating generation of stress and thus avoiding impairment in joining strength. Therefore, even when the ceramic heater 2 is mounted in a subsidiary chamber of an engine for use as a glow plug, and joined portions of the lead wires 15 are exposed to a high temperature of not lower than 300° C., a highly reliable connection is maintained.

Figure 4:
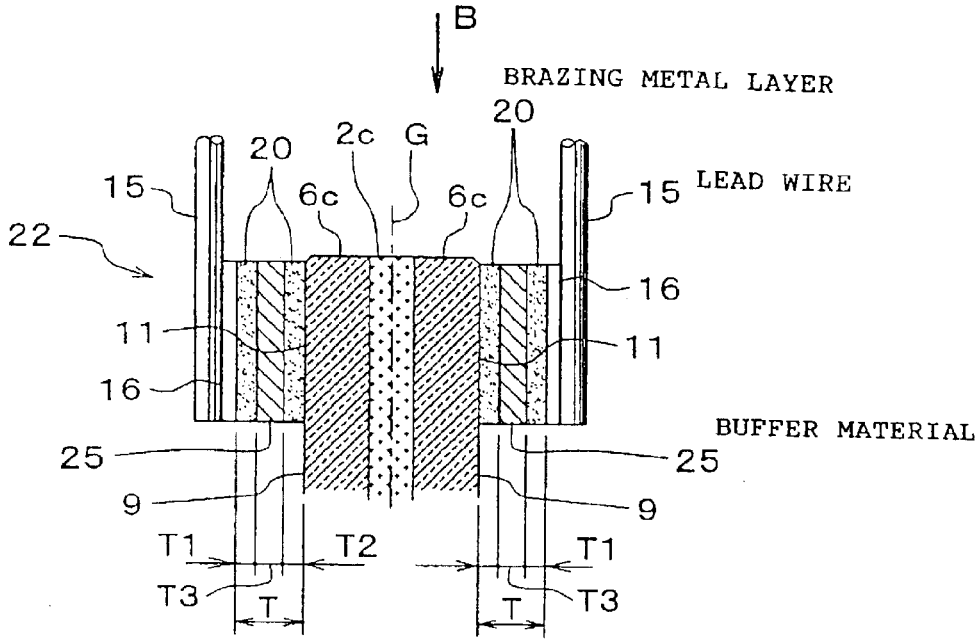
FIG. 4 is an enlarged view of joints of another embodiment between lead wire connection terminals and lead wires.
Figure 5:
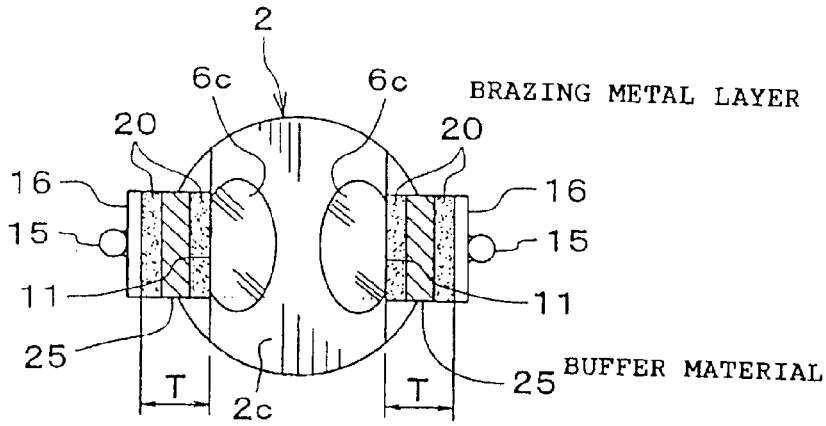
FIG. 5 is a view in the direction of arrow B in FIG. 4.

Since the present embodiment uses a copper brazing metal which contains Si and Ti as activation metals in an appropriate amount, there is no need to form a metallization layer on the ceramic surfaces serving as the lead wire connection terminals 11, thereby simplifying the fabrication process. Also, an increase in brazing metal cost is not incurred. In the present embodiment, the brazing metal layer 20 assumes a thickness T1 of about 60 $\mu$m. However, preferably, the thickness T1 is increased to the greatest possible extent. The thickness T1 can be increased to 300–400 $\mu$m, for example, by melting a plurality of brazing metal foils arranged in layers by applying heat or performing the joining work by use of an interjacent copper plate. FIGS. 4 and 5 exemplify such a joining practice.

FIGS. 4 and 5 shows an example of joining employed in a ceramic heater 22, in which a buffer plate (a buffer material) 25 formed of copper is present between each lead wire connection terminal 11 and the pad 16 of the corresponding lead wire 15, and joining is performed such that the buffer plate 25 is sandwiched between layers of copper brazing metal 20. That is, the pad 16 and the buffer plate 25 formed of copper (a copper plate) as well as the buffer plate 25 formed of copper (a copper plate) and the lead wire connection terminal 11 are respectively joined by use of the copper brazing metal 20. After such joining, the buffer plate 25 and the copper brazing metal are integrally formed into a brazing metal layer. Therefore, the brazing metal layer 20 having a thickness T1, the brazing metal layer 20 having a thickness T2, and the buffer plate 25 constitute a thick brazing metal layer T. As a result, in addition to copper brazing metal preventing the occurrence of migration, easiness of deformation of the copper brazing metal arising from thermal expansion difference after joining contributes greatly to reducting residual stress in ceramic.

The larger the thickness of the brazing metal layer, the more it becomes difficult to control the thickness. However, use of an interjacent buffer plate formed of copper enables integration of the buffer plate and a brazing metal. Thus, when such an interjacent buffer plate is used, the thickness of the brazing metal layer including the buffer plate can be easily controlled. When such a buffer plate formed of copper is not used, for example, a plurality of copper brazing metal foils must be arranged in layers for adjustment of weight, which is troublesome work. Use of an interjacent buffer plate facilitates control of the thickness of a brazing metal layer.

In both the above-described embodiments, each of the lead wires 15 has the pad 16 formed at its end. However, such a pad is unnecessary if lead wires assume the form of a flat strip. In the case of lead wires having a circular cross section, their end portions may be deformed or rolled flat.

In relation to the above-described forms of joining, various copper brazing metals (samples) of different components (different copper and activation metal contents) were prepared; by use of the various copper brazing metals, joined body (ceramic heater) samples were fabricated while the thickness of a brazing metal layer and a like parameter were varied; and the samples were evaluated as described below so as to examine migration resistance from a change in resistance and the joining strength of a joint. The samples were placed in a furnace maintained at a temperature of 400° C., and a DC voltage of 25 V was applied to their lead wires. After 100 hours, the samples were measured for a change in resistance and the joining strength of a joint. The joining strength of a joint was examined in the following manner: a lead wire was pulled along the axis G to check to see if the lead wire breaks or to measure the breaking load of a joint. When a change in resistance is not greater than 1%, and a joint is broken, the sample was judged free from the occurrence or progress of migration. In the case of Sample Nos. 13–17, which represent Comparative Examples, the thickness of the brazing metal layer was set to 25 $\mu$m, which is a standard thickness for this kind of a brazing metal layer.

Materials for the ceramic heater components were as follows: ceramic substrate: insulating ceramic; for example, ceramic which contains a predominant amount of silicon nitride ($Si_3N_4$: 85% by mass, rare-earth metal oxides: 10% by mass, SiO2: 5% by mass); ceramic heating element on the side toward the front end: WC: 50% by mass, $Si_3N_4$: 44% by mass, rare-earth metal oxides: 4% by mass, $SiO_2$: 2% by mass; and ceramic heating element on the side toward the rear end: WC: 60% by mass, $Si_3N_4$: 35% by mass, rare-earth metal oxides: 3% by mass, $SiO_2$: 2% by mass.

TABLE 1

Change in Resistance after Application of Voltage and Joining Strength of Brazed Portions of Lead Wires as Examined by Tensile Test

| Sample No. | Composition of brazing metal (% by mass) Cu | Ag | Si | Al | Pd | In | Ti | Brazing conditions ° C. × hours | Thickness of brazing metal layer (μm) | Thickness of copper buffer plate (μm) | Test results Change in resistance | Joining strength |
|---|---|---|---|---|---|---|---|---|---|---|---|---|
| 1 | 95 | | 3 | | | | 2 | 1075 × 1 | 70 | AAA | 1% or less | BBB |
| 2 | 93 | | 3 | | 2 | | 2 | 1065 × 1 | 75 | AAA | 1% or less | BBB |
| 3 | 92 | | 3 | | 2 | | 2 | 1060 × 1 | 65 | AAA | 1% or less | BBB |
| 4 Comp. Ex. | 91 | | 3 | 2 | | | 4 | 1070 × 1 | 25 | AAA | 1% or less | 68.6 N * |
| 5 | 91 | | 3 | 2 | | | 4 | 1070 × 1 | 30 | AAA | 1% or less | BBB |
| 6 | 91 | | 3 | 2 | | | 4 | 1070 × 1 | 60 | AAA | 1% or less | BBB |
| 7 | 91 | | 3 | 2 | | | 4 | 1070 × 1 | 140 | 100 | 1% or less | BBB |
| 8 | 91 | | 3 | 2 | | | 4 | 1070 × 1 | 400 | 300 | 1% or less | BBB |
| 9 Comp. Ex. | 91 | | 3 | 2 | | | 4 | 1070 × 1 | 450 | 400 | 26% | 10.8 N * |
| 10 | 90 | | 2 | | 3 | | 5 | 1060 × 1 | 75 | AAA | 1% or less | BBB |
| 11 | 89 | | 4 | | 4 | | 3 | 1070 × 1 | 90 | AAA | 1% or less | BBB |
| 12 | 85 | | 5 | | 5 | | 5 | 1080 × 1 | 70 | AAA | 1% or less | BBB |
| 13 Comp. Ex. | 25 | 60 | 1 | | | 12 | 2 | 800 × 1 | 25 | AAA | 3.5% | 61.7 N * |
| 14 Comp. Ex. | 35 | 63 | | | | | 2 | 830 × 1.5 | 25 | AAA | 2.2% | 56.8 N * |
| 15 Comp. Ex. | 5 | 92 | | | | | 2 | 950 × 1 | 25 | AAA | 5.2% | 51.0 N * |
| 16 Comp. Ex. | | 86 | | | 10 | 2 | 2 | 1080 × 1 | 25 | AAA | 2.9% | 48.0 N * |
| 17 Comp. Ex. | | 86 | | | 10 | 2 | 2 | 1080 × 1 | 80 | 200 | 2.0% | 62.7 N * |

AAA: No buffer plate
BBB: Lead wire broken
The mark * denotes the occurrence of migration.

As shown in Table 1, in the case of the Samples in which joining was performed by use of a brazing metal which contains copper in an amount of not less than 85% by mass, a change in resistance was as low as not greater than 1% as compared with the Comparative Examples (in which joining is performed by use of a brazing metal which contained a predominant amount of a metal other than copper or which contained a predominant amount of silver). Further, at a tensile test on lead wire joints, all lead wires were broken. Additionally, the joints were free from separation. These test results denote that the present embodiment (Sample Nos. 1–5) is free from the occurrence or progress of migration.

In the case of Sample No. 4, in which the brazing metal layer had a thickness of 25 μm, which is rather thin for copper brazing metal, the joint was broken at a somewhat small load of 68.6 N. In the case of Sample No. 9, in which the brazing metal layer including a buffer plate had a rather large thickness of 450 μm, a large change in resistance of 26% was observed. This denotes that a partial separation occurred at the joint since stress induced by thermal shrinkage becomes excessively large due to an excessively large thickness of the copper layer. Therefore, when Sample No. 9 was subjected to a tensile test, the joint was broken at a small load of 10.8 N. Notably, the breaking load of a lead wire as measured by a tensile test is about 98 N.

In the case of Sample Nos. 13–15 (Comparative Examples), in which joining was performed using a brazing metal which contained silver in a predominant amount (60–92% by mass) and copper in a small amount of 5–35% by mass, and Sample Nos. 16 and 17 (Comparative Examples), in which joining was performed using a brazing metal which contained silver in a predominant amount (86% by mass) and no copper, the change in resistance was in excess of 2%. Further, in a tensile test on the lead wire joints, the lead wires were not broken, but the joints were broken under a small load. These test results indicate that migration occurred in the Comparative Examples represented by Sample Nos. 13–15 and Samples 16 and 17. In the Comparative Example represented by Sample No. 17, a copper buffer plate was used, but a change in resistance of 2% was observed. This indicates that migration occurred as a result of using a brazing metal which contained a predominant amount of silver.

The above-described test results denote that an effective joint is provided by using a brazing metal which contains copper in an amount of not less than 85% by mass. Also, an effective joint is provided by employing a brazing metal thickness of 30–400 μm, regardless of whether a buffer plate is present or not. In the case of Sample Nos. 7 and 8, in which the brazing metal layer had a large thickness of 140 μm and 400 μm and included a buffer plate formed of copper, favorable test results were obtained. These test results demonstrate the effectiveness of the present invention.

Next, the same samples which had been used in the above-described test were subjected to heat cycle evaluation. Particularly, the samples were subjected to an endurance test in the following manner: the samples were subjected to 1000 heat cycles using a gas-phase thermal test apparatus, each heat cycle consisting of exposure to a temperature of 40° C. for one minute and exposure to a temperature of 500° C. for 5 minutes. Subsequently, a tensile test was conducted on lead wire joints of the samples to thereby verify the influence of the heat cycles on joining strength. The test results are shown in Table 2.

TABLE 2

Joining Strength of Brazed Portions of Lead Wires as Examined by Tensile Test Conducted after Heat Cycle Test

| Sample No. | Composition of brazing metal (% by mass) Cu | Ag | Si | Al | Pd | In | Ti | Brazing conditions ° C. × hours | Thickness of brazing metal layer (μm) | Thickness of copper buffer plate (μm) | Test results Joining strength |
|---|---|---|---|---|---|---|---|---|---|---|---|
| 1 | 95 | | 3 | | | | 2 | 1075 × 1 | 70 | No buffer plate | Lead wire broken |
| 2 | 93 | | 3 | | 2 | | 2 | 1065 × 1 | 75 | No buffer plate | Lead wire broken |
| 3 | 92 | | 3 | | 2 | | 2 | 1060 × 1 | 65 | No buffer plate | Lead wire broken |
| 4 Comp. Ex. | 91 | | 3 | 2 | | | 4 | 1070 × 1 | 25 | No buffer plate | 68.6 N |
| 5 | 91 | | 3 | 2 | | | 4 | 1070 × 1 | 30 | No buffer plate | Lead wire broken |
| 6 | 91 | | 3 | 2 | | | 4 | 1070 × 1 | 60 | No buffer plate | Lead wire broken |
| 7 | 91 | | 3 | 2 | | | 4 | 1070 × 1 | 140 | 100 | Lead wire broken |
| 8 | 91 | | 3 | 2 | | | 4 | 1070 × 1 | 400 | 300 | Lead wire broken |
| 9 Comp. Ex. | 91 | | 3 | 2 | | | 4 | 1070 × 1 | 450 | 400 | 10.8 N |
| 10 | 90 | | 2 | | 3 | | 5 | 1060 × 1 | 75 | No buffer plate | Lead wire broken |
| 11 | 89 | | 4 | | 4 | | 3 | 1070 × 1 | 90 | No buffer plate | Lead wire broken |
| 12 | 85 | | 5 | | 5 | | 5 | 1080 × 1 | 70 | No buffer plate | Lead wire broken |
| 13 Comp. Ex. | 25 | 60 | 1 | | | 12 | 2 | 800 × 1 | 25 | No buffer plate | 47.0 N |
| 14 Comp. Ex. | 35 | 63 | | | | | 2 | 830 × 1.5 | 25 | No buffer plate | 48.0 N |
| 15 Comp. Ex. | 5 | 92 | | | | | 2 | 950 × 1 | 25 | No buffer plate | 59.8 N |
| 16 Comp. Ex. | | 86 | | | 10 | 2 | 2 | 1080 × 1 | 25 | No buffer plate | 61.7 N |
| 17 Comp. Ex. | | 86 | | | 10 | 2 | 2 | 1080 × 1 | 80 | 200 | 51.9 N |

As shown in Table 2, in the case of the Samples in which joining was performed, by use of a brazing metal which contained copper in an amount of not less than 85% by mass, such that the brazing metal layer had a thickness of 25–400 μm, the lead wires were broken without separation or unjoining of joints. This indicates that, upon exposure to heat cycles, a copper layer serving as a brazing metal layer absorbed generated stress by shrinking or deforming in accordance with the heat cycles, since the copper layer thickness was appropriate. In the case where joining was performed such that the thickness of the brazing metal layer was 450 μm, joints were broken. This indicates that, upon exposure to heat cycles, the copper layer serving as a brazing metal layer failed to shrink or deform in accordance with the heat cycles, since the copper layer was too thick. Also, in the case of the Comparative Examples (Sample Nos. 13 and 15), joints were broken. This indicates that the brazing metal layer failed to shrink or deform in accordance with the heat cycles with a resultant failure to absorb stress, since the copper content of the brazing metal layer was low. A brazing metal layer which contains a predominant amount of copper cannot absorb stress if it is too thin or too thick.

Figure 6:
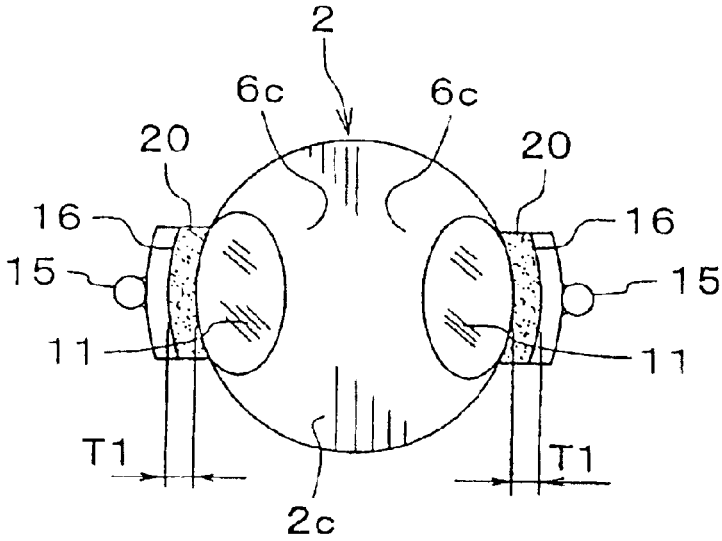
FIG. 6 is a view of still another embodiment of joints between lead wire connection terminals and lead wires as viewed from the rear end of a ceramic heater (as viewed in the direction of arrow B).
Figure 7:
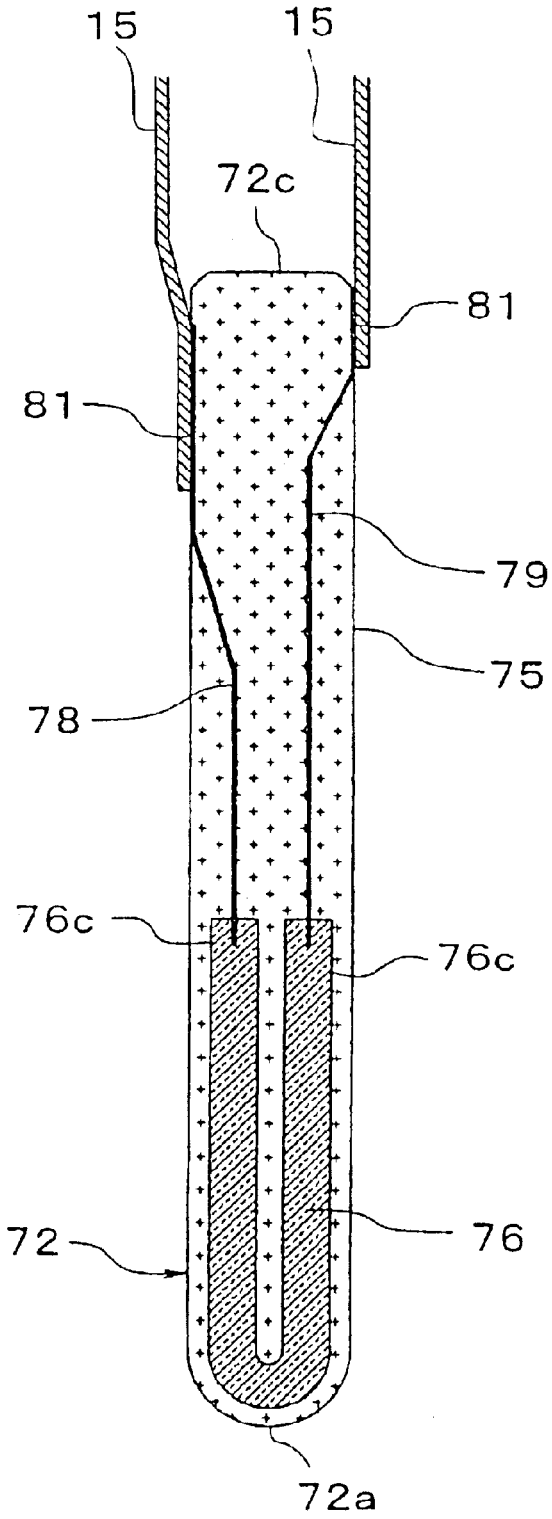
Fig. 7 PRIOR ART
FIG. 7 is a vertical front section of a conventional ceramic heater.

The present invention is not limited to the above-described embodiment, but may be embodied in many other specific forms without departing from the spirit or scope of the invention. For example, the above embodiment employed heating elements and lead wire connection terminals formed of electrically conductive ceramic. However, the heating elements and the lead wire connection terminals may be formed of a high-melting-point metal, such as W or Mo, or a high-melting-point metallic compound, such as WC or TiN. Also, the above embodiment employed a lead wire connection terminal 11 implemented by flattening a side surface of the ceramic heater. However, as shown in FIG. 6, the lead wire connection terminal 11 may be implemented by a cylindrical surface. In this case, the pad 16, which serves as a joint of the lead wire 11, may assume a concave, cylindrical surface which matches the cylindrical surface of the lead wire connection terminal 11.

In the present invention, the ceramic substrate may be formed of an insulating ceramic whose composition is determined as appropriate, for example, according to the desired application of the ceramic heater.

As understood from the above-described test results, the present invention can provide a joint structure which does not exhibit impaired joining strength induced by exposure to heat cycles, or the occurrence of migration, and which does not incur increased manufacturing cost. This is because a brazing metal which contains a predominant amount of copper is used to join a lead wire connection terminal and a lead wire. Therefore, the present invention is particularly effectively applied to a glow plug in which lead wire joints are exposed to a high temperature of not lower than 300° C. as a result of satisfying a demand for a reduction in size.

This application is based on Japanese Patent Application No. 2001-065798 filed Mar. 8, 2001, which is incorporated herein by reference in its entirety.

What is claimed is:

1. A ceramic heater comprising a heating element embedded in an insulating ceramic substrate, and a lead wire joined to a lead wire connection terminal via a brazing metal which contains a predominant amount of copper and further contains Ti and Si as activation metals, each in an amount of 0.1–5% by mass of the brazing metal, wherein electrical continuity is established between the lead wire, lead wire connection terminal and heating element.

2. The ceramic heater as claimed in claim 1, wherein the brazing metal contains copper in an amount of not less than 85% by mass.

3. The ceramic heater as claimed in claim 1, comprising a pad formed on the lead wire so as to serve as a joining surface to be joined to the lead wire connection terminal, the lead wire being joined to the lead wire connection terminal via the pad.

4. The ceramic heater as claimed in claim 1, wherein the brazing metal joining the lead wire and the lead wire connection terminal is a layer having a thickness of 30–400 μm.

5. The ceramic heater as claimed in claim 4, comprising an interjacent buffer plate formed of copper present in the layer of brazing metal joining the lead wire and the lead wire connection terminal, and the thickness of the layer of brazing metal includes that of the buffer plate formed of copper.

6. The ceramic heater as claimed in claim 1, wherein the brazing metal joining the lead wire and the lead wire connection terminal is a layer having a thickness of 50–300 μm.

7. The ceramic heater as claimed in claim 6, comprising an interjacent buffer plate formed of copper present in the layer of brazing metal joining the lead wire and the lead wire connection terminal, and the thickness of the layer of brazing metal includes that of the buffer plate formed of copper.

8. The ceramic heater as claimed in claim 1, wherein the brazing metal joining the lead wire and the lead wire connection terminal is a layer having a thickness of 150–250 μm.

9. The ceramic heater as claimed in claim 8, comprising an interjacent buffer plate formed of copper present in the layer of brazing metal joining the lead wire and the lead wire connection terminal, and the thickness of the layer of brazing metal includes that of the buffer plate formed of copper.

10. A ceramic heater comprising a heating element embedded in an insulating ceramic substrate, and a lead wire joined to a lead wire connection terminal via a brazing metal which contains a predominant amount of copper, wherein electrical continuity is established between the lead wire, lead wire connection terminal and heating element, wherein the brazing metal joining the lead wire and the lead wire connection terminal is a layer having a thickness of 30–400 μm.

11. The ceramic heater as claimed in claim 10, wherein the brazing metal joining the lead wire and the lead wire connection terminal is a layer having a thickness of 50–300 μm.

12. The ceramic heater as claimed in claim 11, comprising an interjacent buffer plate formed of copper present in the layer of brazing metal joining the lead wire and the lead wire connection terminal, and the thickness of the layer of brazing metal includes that of the buffer plate formed of copper.

13. The ceramic heater as claimed in claim 10, wherein the brazing metal joining the lead wire and the lead wire connection terminal is a layer having a thickness of 150–250 μm.

14. The ceramic heater as claimed in claim 13, comprising an interjacent buffer plate formed of copper present in the layer of brazing metal joining the lead wire and the lead wire connection terminal, and the thickness of the layer of brazing metal includes that of the buffer plate formed of copper.

15. The ceramic heater as claimed in claim 10, comprising an interjacent buffer plate fanned of copper present in the layer of brazing metal joining the lead wire and the lead wire connection terminal, and the thickness of the layer of brazing metal includes that of the buffer plate formed of copper.

* * * * *

UNITED STATES PATENT AND TRADEMARK OFFICE

CERTIFICATE OF CORRECTION

PATENT NO. : 6,794,614 B2 
APPLICATION NO. : 10/091445
DATED : September 21, 2004
INVENTOR(S) : Masato Taniguchi and Manabu Okinaka It is certified that error appears in the above-identified patent and that said Letters Patent is hereby corrected as shown below:

Col. 10,
In claim 1: should read

--1. A ceramic heater comprising a heating element embedded in an insulating ceramic substrate, a leg of the heating element having an exposed surface which serves as a lead wire connection terminal, and a lead wire joined to a lead wire connection terminal via a brazing metal which is bonded directly to the lead wire connection terminal, wherein the brazing metal contains a predominant amount of copper and further contains Ti and Si as activation metals, each in an amount of 0.1-5% by mass of the brazing metal, wherein electrical continuity is established between the lead wire, lead wire connection terminal and heating element. --

In claim 3: should read

--3. The ceramic heater as claimed in claim 1, comprising a pad formed on the lead wire so as to serve as a joining surface to be joined to the lead wire connection terminal, the pad formed on the lead wire being joined to the lead wire connection terminal via the brazing metal provided between the pad and the lead wire connection terminal. --

Col. 12,
In claim 15: should read

--15. The ceramic heater as claimed in claim 10, comprising an interjacent buffer plate ~~fanned~~ formed of copper present in the layer of brazing metal joining the lead wire and the lead wire connection terminal, and the thickness of the layer of brazing metal includes that of the buffer plate formed of copper. --

Signed and Sealed this

Sixteenth Day of October, 2007

JON W. DUDAS
*Director of the United States Patent and Trademark Office*